United States Patent [19]

Biehl et al.

[11] 4,360,201

[45] Nov. 23, 1982

[54] RACQUETBALL OR TENNIS RACQUET

[75] Inventors: Roy J. Biehl, 1133 N. Water St., Milwaukee, Wis. 53202; Kenneth L. Baron, Monroeville, Pa.

[73] Assignee: Roy J. Biehl, Milwaukee, Wis.

[21] Appl. No.: 135,225

[22] Filed: Mar. 31, 1980

Related U.S. Application Data

[63] Continuation of Ser. No. 17,433, Mar. 5, 1979, abandoned.

[51] Int. Cl.[3] ..... A63B 49/02

[52] U.S. Cl. ..... 273/73 C

[58] Field of Search ..... 273/67 R, 67 B, 72 R, 273/73 R, 73 C, 73 D, 73 F, 73 J, 75, 76, 81.4; D21/211, 212, 213

[56] References Cited

U.S. PATENT DOCUMENTS

| | | | |
|---|---|---|---|
| D. 168,192 | 11/1962 | Schmid | 273/76 X |
| D. 191,405 | 9/1961 | Wagner | 273/76 X |
| D. 255,137 | 5/1980 | Bowen | 273/76 X |
| D. 256,708 | 9/1980 | Lo | D21/212 |
| 412,479 | 10/1889 | Davis | 273/81.4 X |
| 1,700,251 | 1/1929 | Contolini | 273/67 B |
| 2,205,769 | 6/1940 | Sweetland | 273/81.4 X |
| 2,382,304 | 8/1945 | Foltz et al. | 273/81.4 X |
| 2,394,184 | 2/1946 | Janis | 273/72 R |
| 3,272,193 | 9/1966 | Olecko | 273/81.4 X |
| 3,545,755 | 12/1970 | Owada | 273/73 C |
| 3,554,545 | 1/1971 | Mann | 273/72 R |
| 3,834,699 | 9/1974 | Pass | 273/73 D |
| 3,868,110 | 2/1975 | Jones | 273/75 |
| 4,079,935 | 3/1978 | Gormley | 273/67 R |
| 4,131,278 | 12/1978 | Goldenberg | 273/67 R |
| 4,147,348 | 4/1979 | Lee | 273/73 C |

FOREIGN PATENT DOCUMENTS

| | | | |
|---|---|---|---|
| 2407213 | 8/1975 | Fed. Rep. of Germany | 273/76 |
| 2610872 | 9/1977 | Fed. Rep. of Germany | 273/76 |
| 2709568 | 9/1977 | Fed. Rep. of Germany | 273/76 |
| 190183 | 6/1937 | Switzerland | 273/67 R |

*Primary Examiner*—Richard J. Apley

*Attorney, Agent, or Firm*—Andrus, Sceales, Starke & Sawall

[57] ABSTRACT

A racquetball or tennis racquet having a frame of polygonal configuration within which the webbing of the racquet is held for engagement of the ball to be hit. The frame includes two flat or straight sections, one on the end of the RACQUET and one on one side which provides for more webbing in those areas and permits the flat end section of the racquet to be used closer to the playing surface and the flat side section of the racquet to be used closer to the wall. The frame terminates rearwardly in a throat in turn terminating in a shaft which is encased with contoured grips on each side to form a handle for the racquet which will receive the grasp of a hand of the player and which terminates in an enlarged butt end thus preventing slipping of the hand of the player off the handle. The rotational balance line extending through the handle and projecting through the web containing enclosure is inclined with respect to the major substantially longitudinal axis of the web receiving area so that the grip is spaced from the major axis in a direction toward the greater web receiving area.

5 Claims, 6 Drawing Figures

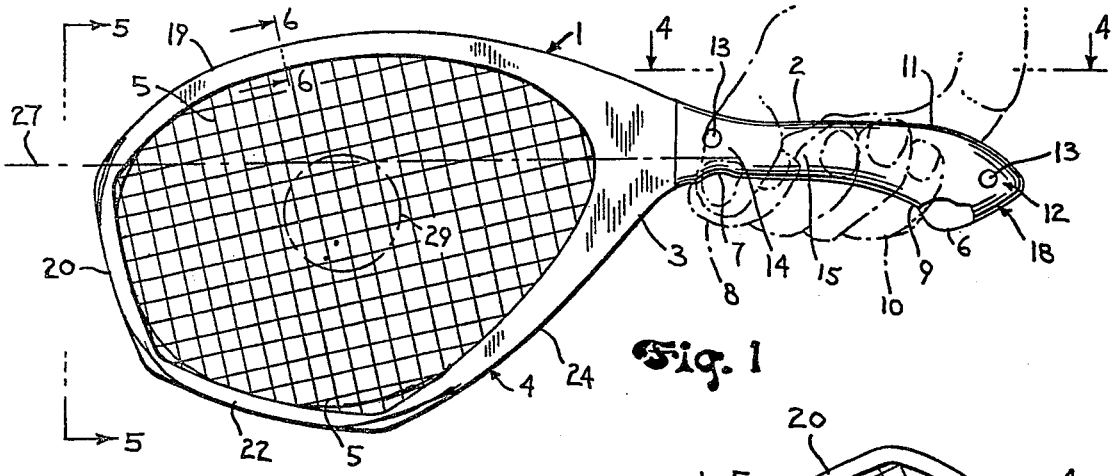
Fig. 1
Fig. 2
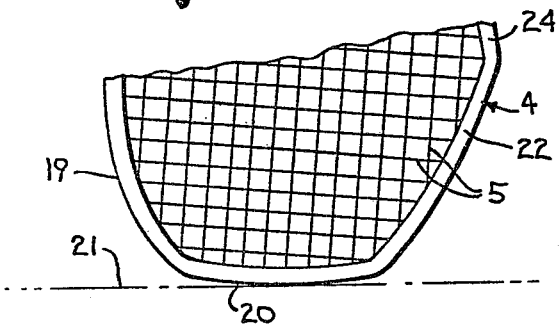
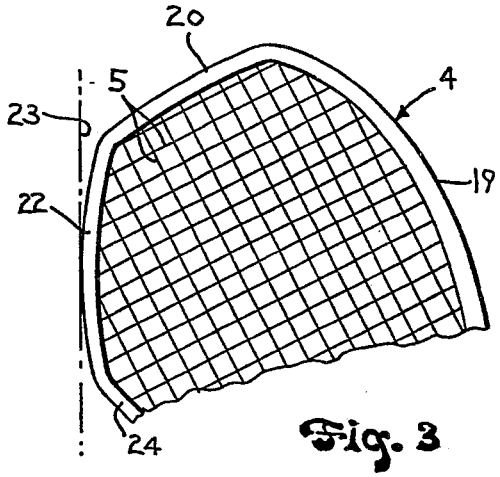
Fig. 3
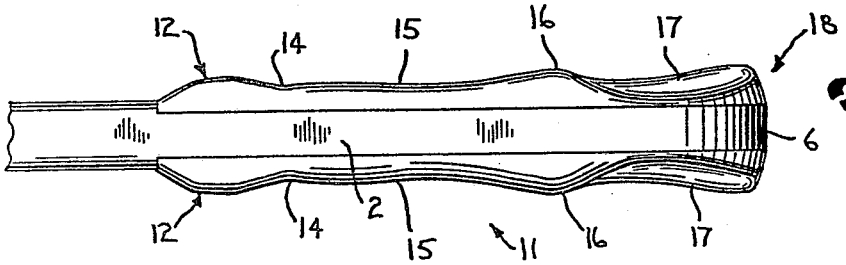
Fig. 4
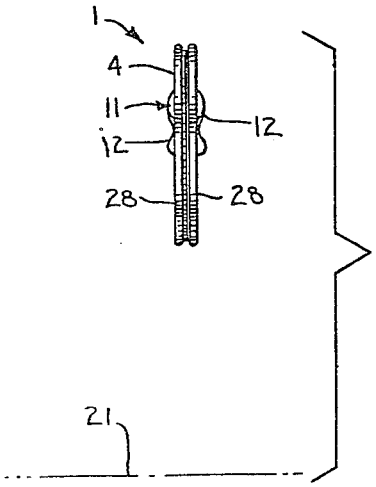
Fig. 5
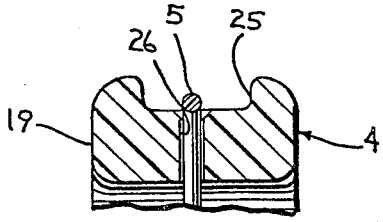
Fig. 6

RACQUETBALL OR TENNIS RACQUET

RELATED APPLICATION

This is a continuation application of copending U.S. application Ser. No. 17,433 filed on Mar. 5, 1979, now abandoned.

BACKGROUND OF THE INVENTION

The construction of the racquet of the invention is directed to the design, balance, grip and sweet spot all interacting together to provide more power and control by the player with less effort and faster, split second-eye to ball to racquet mental calculation in the player's mind of how the shot should be handled. All this makes for a faster, more controlled game and aids in helping beginners.

SUMMARY OF THE INVENTION

The invention is directed to a racquet which can be constructed to be used for tennis or racquetball or the like. In general the racquet has a contoured handle with symetrical grips terminating in a large butt which are assembled around a central shaft provided as part of the frame of the racquet. The shaft and grips are contoured with indentations to receive the index finger in one of the indentations and to hold the little finger in the other indentation against rearward movement and additional contoured to naturally fit the palm of the hand. The area between the indentations is substantially free of indentations to permit movement of the hand in such area. Because of the contour of the handle, the racquet takes a proper position when held loosely in the player's hand with the faces of the racquet perpendicular to the playing surface or floor. In addition, the contour of the handle permits the racquet to be held only one way, perpendicular to the floor. The racquet will not rotate in the player's hand and if a thong is used, the latter will not twist tightly about the wrist. A topside portion of the handle tapers downwardly and rearwardly to avoid interference with the heel of the hand.

The handle is formed continuous with the throat of the frame of the racquet and the remainder of the frame extends forwardly to provide an enclosure in the shape of a polygon. In this configuration a first section of the enclosure extends forwardly from one side of the throat in a somewhat arcing manner to provide the first side of the polygonal enclosure and then turns inwardly at the outer end and terminates in a generally flat section at the outer end of the racquet to provide the second section of the polygonal enclosure. From the outer flat section the enclosure turns rearwardly in an arc-like pattern and then terminates in the second side portion of the racquet in a third flat section somewhat longer than the end flat section. The second flat section is the third side of the polygon and terminates through an arcing pattern in a section which completes the second side of the racquet as it extends rearwardly to the throat of the racquet to provide the fourth side of the polygon and close the enclosure of the frame of the racquet at the throat.

The enclosure of the frame of the racquet is strung through holes located within a groove therein with a suitable material, such as gut, nylon or the like, to provide the enclosure of the frame with a generally wide webbing to engage the ball to be hit by the player. Because of the described polygonal configuration of the enclosure of the frame and the two flat surfaces in the end and side of the enclosure, the webbing is provided with a greater linear surface at the outer end portion which is disposed parallel to the playing surface and likewise there is greater linear surface of the webbing provided parallel to a side wall confining the court in racquetball play.

A rotational balance line extends through the handle and projects through the enclosure of the frame to establish a greater web receiving area on one side of the rotational balance line as compared to the web receiving area on the opposite side of the line. The rotational balance line is proximate to a "sweet spot" of the webbing which, in turn, is substantially spaced from the frame sections. Such rotational balance line permits substantial balanced use of said racquet with an operator's hand totally spaced from the enclosure and the webbing.

BRIEF DESCRIPTION OF THE DRAWINGS

FIG. 1 is a front view of the racquet;

FIG. 2 is a partial view of the front of the racquet with the racquet in a different orientation than in FIG. 1;

FIG. 3 is a view similar to FIG. 2 but with the racquet in a still different orientation;

FIG. 4 is a view of the handle of the racquet taken on line 4—4 of FIG. 1;

FIG. 5 is a section taken on line 5—5 of FIG. 1 showing the perpendicular balanced orientation of the faces of the racquet with respect to the playing surface; and FIG. 6 is a section taken on line 6—6 of FIG. 1 and illustrates the groove in the frame of the racquet and a string of the webbing extending therein.

DESCRIPTION OF THE PREFERRED EMBODIMENT

Referring to the drawings there is shown in FIG. 1 a racquet which may be used for racquetball, tennis or the like. The racquet has a frame 1 which may be formed from suitable material by molding or extrusion or the like. Frame 1 consists of the shaft 2 which merges into the throat 3 and from which forwardly extends the enclosures 4 to support the webbing 5 which is engaged by the ball to be played.

Shaft 2 extends rearwardly from throat 3 in a generally downwardly arc-like pattern to terminate in an enlarged end 6, the lower portion of which terminates in a horizontal plane when the racquet is held perpendicular to the playing surface below that of the forward end of shaft 2. This construction contributes to the balance of the racquet in a vertical plane. The underside of the shaft has an indentation 7 adjacent the forward end which receives the index finger 8 of the player, as illustrated in FIG. 1. On the underside of shaft 2 in the approach to the end 6 is an indentation 9 to provide an abutment for the little finger 10, as illustrated in FIG. 1.

Shaft 2 is formed into the handle 11 of the racquet shown as a pair of contoured side grips 12, as illustrated in FIG. 4, which are secured at each end by pins 13 to shaft 2 and encapsulate the sides of shaft 2. However, grips 12 could be a single member molded around the entire shaft.

Grips 12 in their rearward extent take the contour of shaft 2 but have features which fit handle 11 to the hand of the player in a natural manner and aids in eliminating rotation of the racquet in the hand of the player. Thus the forward end portion of each side member 12 is contoured slightly outwardly and extends inwardly to be inset as at 14 complementary to indentation 7 in shaft 2.

As shaft 2 and side grips 12 proceed rearwardly, grips 12 of handle 11 become thinner in a vertical cross section as at the generally central portion 15. This provides for ready grasping of handle 11 by the player.

Proceeding further rearwardly of handle 11 there is provided an outwardly contoured enlargement 16 in grips 12 immediately removed forwardly from the enlarged end 6 of shaft 2 and forwardly of indentations 9 in which the little finger 10 is located when handle 11 is grasped. The enlargement 16 on one side of the grips rests in the palm of the hand of the player. Grips 12 then taper inwardly in their extent rearwardly to end 6, as at 17. From inward taper 17 side grips 12 then taper downwardly to provide the end 6 of handle 11 with the enlarged butt 18.

Enclosure 4 of frame 1 which extends forwardly from throat 3 has a generally polygonal configuration. The first section 19 of the polygonal enclosure provides the first side of the racquet and extends forwardly and outwardly from throat 3 and then inwardly to the front end of the racquet in an arc-like pattern. First section 19 terminates in a second section 20 at the outer end of the racquet which has a generally straight or flat extent. This can be particularly observed in FIG. 2. As there shown, the generally flat section 20 of enclosure 4 may extend substantially parallel to the playing surface 21. This construction provides a greater linear surface of webbing 5 parallel to the playing surface 20 for engagement of the ball in play.

Generally flat end section 20 of enclosure 4 terminates in a generally flat or straight third section 22 on the second side of the racquet which extends outwardly and generally rearwardly of section 20. As shown in FIG. 3, third section 20 may extend in play generally parallel to the wall 23 of a court to provide a greater linear surface of webbing 5 available in that area parallel to wall 23.

The polygonal enclosure 4 is completed by a fourth section 24 which completes the second side of the racquet and curves rearwardly in an arc-like pattern from the third section 22 and terminates in throat 3.

Enclosure 4 of frame 1 is provided with the groove 25 throughout and intermittent holes 26 are provided therein to receive the strings of webbing 5 inset within groove 25 to prevent injury. This construction is illustrated in FIGS. 5 and 6.

The balancing features of the racquet of the invention are extremely important. The balance of the racquet with respect to rotation is around the line 27 designated in FIG. 1 of the drawing, and is close to the palm of the hand. Line 27 extends through handle 11 and is projected through the enclosure 4 of frame 1 of the racquet. The balance of the racquet in a direction perpendicular to the playing surface is accomplished by the mass of the entire handle 11 formed to balance the weight of the greater amount of webbing 32 which is located on the side along the flat third section 22 of the enclosure 4 as compared to the webbing 33 in the side areas of the normal racquet. Also, butt 18 balances the offset second side of the racquet.

The balancing of the racquet on the rotational axis relative to the wall and playing surface allows for a more controllable ball return. The racquet normally falls into its proper position when held loosely in the player's hand with the face surfaces 28 of the racquet, as illustrated in FIG. 5, perpendicular to the floor 21.

In addition at least one of the sections is substantially offset from the rotational balance line extending through the handle and projected through the enclosure of the frame. This establishes a greater webbing receiving area adjacent the offset section on the one side of the rotational balance line as compared to the webbing receiving area on the opposite side of the described line. This substantially increases the amount of webbing adjacent the offset section to supply an increased surface in the webbing in difficult return positions with which to engage the ball in play.

The grip 12 functioning with shaft 2 provides a first indentation 14 adjacent to the throat 3 for receiving an index finger 8 of either hand while a second indentation 17 is located to the rear of the grip 12 for receiving a little finger 10 of either hand. An intermediate surface 15 interconnects the indentations 14 and 17 and is substantially free of indentations to allow either hand to shift the grip along such intermediate surface 15 to adjust for various playing conditions.

The shape allows for a more natural swing and there is decreased fatigue on the wrist and fingers and less tension in the hand muscles. The two flat or straight areas in the frame provide increased webbing over the normal racquet at those areas for better returns off the wall and playing surface. With this construction the player bends less and this lessens the strain in returning shots from the playing surface.

Repositioning of the grip from forearm to backhand is easier because the racquet remains in a neutral position when the grip is loosened to reposition. Prepackaged grips can be sold and packaged separately for a more customized racquet. The grips can be made for right or left-handed players, and of a small or large size. The molded to the hand feature of the grips of the handle makes the beginner hold the racquet properly and the racquet is less likely to twist in the hand. The grips may be molded of soft rubber or the like and the contoured features of the grips and the butt end make it less likely for the racquet to slide out of the hand.

In addition, the "sweet spot" 29 shown as a circle in FIG. 1 is located in a more natural position relative to the grip and swing.

Various modes of carrying out the invention are contemplated as being within the scope of the following claims particularly pointing out and distinctly claiming the subject matter which is regarded as the invention.

We claim:

1. In a racquet having a frame providing a handle at the rear end and an enclosure at the forward end extending forwardly from a throat to which the handle is connected, said enclosure being constructed from suitable material in the general form of a polygon comprising a plurality of sections terminating into each other in an arc-like pattern with at least one of the sections substantially offset from a rotational balance line extending through the handle and projected through the enclosure of the frame to establish a greater web receiving area adjacent said offset section on the one side of the rotational balance line as compared to the web receiving area on the opposite side of said line, and webbing in the form of string-like material located inside the enclosure in the web receiving areas and secured to the enclosure of the frame of the racquet to provide a "sweet spot" substantially spaced from said frame sections and the difference in the extent of the web receiving areas providing a substantial increase in the amount of the webbing adjacent said offset section to supply an increased surface in the webbing in difficult return positions with which to engage the ball in play, said handle having a mass spaced from said enclosure to balance the weight of said greater web receiving area to permit substantial balanced use of said racquet with respect to the rotational balance line with an operator's hand totally spaced from said enclosure and said webbing.

2. In a racquet having a frame providing an enclosure at the forward end to receive webbing to engage a ball in play and then extending rearwardly to provide a throat and thence a downwardly curved shaft forming the base of the handle of the racquet, a first indentation in the bottom of the shaft at the forward end and a second corresponding indentation in the bottom of the shaft adjacent the rear of the shaft, and the outer end of the shaft being enlarged in cross section and tapering downwardly, a symetrical contoured gripping means secured to the shaft, a first indentation adjacent the forward end of the gripping means formed complementary to the first indentation in the shaft to receive the index finger of the player, a second indentation adjacent the rear of the gripping means formed complementary to the second indentation in the shaft to form an abutment against which the little finger of the player rests when the racquet is grasped, a generally thinner cross section substantially free of indentation formed in the gripping means between the first and second indentations, an enlargement of the gripping means provided at the rearward termination of the thinner cross section to provide natural form fitting surfaces to receive the palm of the hand and the middle fingers and thumb of the player, and the gripping means having an inward taper rearwardly and then outwardly at the end of the gripping means and enlarged in cross section beyond the second indentation to provide a substantially large butt at the inner end of the handle and a topside portion tapering downwardly and rearwardly to avoid interference with the heel of the hand, and with the lowermost portion of the butt located in a horizontal plane substantially lower than a horizontal plane through the lowermost portion of the bottom of the forward end of the handle.

3. The racquet of claim 2 and the gripping means being separate members secured to the sides of the shaft.

4. In a racquet having a frame providing a handle at the rear end and an enclosure at the forward end extending forwardly from a throat to which the handle is connected to receive webbing to engage a ball in play, said enclosure being constructed from suitable material in the general form of a polygon comprising a first section forming the first side of the racquet extending forwardly from the throat and then inwardly to the front end of the racquet, a second section at the forward end of the racquet into which the first section terminates in an arc-like pattern, said second section having a generally flat extent, a third section forming a portion of the second side of the racquet into which the second section terminates in an arc-like pattern, said third section being generally flat in its rearward extent, a fourth section into which the third section terminates in an arc-like pattern, said fourth section completing the second side of the racquet and extending inwardly to the throat of the racquet to complete the enclosure, and webbing in the form of string-like material located inside the enclosure and secured to the enclosure portion of the frame of the racquet, said second, third and fourth sections of the enclosure located on a first side of a rotational balance line extending through the handle and projected through the enclosure of the frame while said first section is located on a second side of said rotational balance line to establish a substantial increase in the amount of the webbing between said flat second, third and fourth sections and said rotational balance line.

5. A racquet having a frame providing an enclosure at the forward end to receive webbing to engage a ball in play and then extending rearwardly to provide a throat and thence a downwardly curved shaft forming the base of the handle of the racquet, a first indentation in the bottom of the shaft at the forward end and a second corresponding indentation in the bottom of the shaft adjacent the rear of the shaft being enlarged in cross section and tapering downwardly, a contoured gripping means secured to the shaft, a first indentation adjacent the forward end of the gripping means formed complementary to the first indentation in the shaft to receive the index finger of the player, a second indentation adjacent the rear of the gripping means formed complementary to the second indentation in the shaft to form an abutment against which the little finger of the player rests when the racquet is grasped, a generally thinner cross section formed in the gripping means between the first and second indentations and an enlargement of the gripping means provided at the rearward termination of the thinner cross section to provide natural form fitting surfaces to receive the palm of the hand and the middle fingers and thumb of the player, and the gripping means having an inward taper rearwardly and then outwardly at the end of the gripping means and enlarged in cross section beyond the second indentation to provide a substantially large butt at the inner end of the handle and with the lowermost portion of the butt located in a horizontal plane substantially lower than a horizontal plane through the lowermost portion of the bottom of the forward end of the handle, said enclosure being constructed from suitable material in the general form of a polygon comprising a first section forming the first side of the racquet extending forwardly and outwardly from the throat and then inwardly to the front end of the racquet, a second section at the forward end of the racquet into which the first section terminates in an arc-like pattern, said second section having a generally flat extent, a third section forming a portion of the second side of the racquet into which the second section terminates in an arc-like pattern, said third section being generally flat in its rearward extent, a fourth section into which the third section terminates in an arc-like pattern, said fourth section completing the second side of the racquet and extending inwardly to the throat of the racquet to complete the enclosure, and webbing in the form of string-like material located inside the enclosure and secured to the enclosure portion of the frame of the racquet, said second, third, and fourth sections of the enclosure located on a first side of a rotational balance line extending through the handle and projected through the enclosure of the frame while said first section is located on a second side of said rotational balance line to establish a substantial increase in the amount of the webbing between said flat second, third and fourth sections and said rotational balance line.

* * * * *